US006880613B2

(12) United States Patent
Saha et al.

(10) Patent No.: US 6,880,613 B2
(45) Date of Patent: Apr. 19, 2005

(54) SEMI-SOLID METAL CASTING PROCESS OF HYPOEUTECTIC ALUMINUM ALLOYS

(75) Inventors: Deepak Saha, Worcester, MA (US); Diran Apelian, West Boylston, MA (US); Mark A. Musser, Osceola, IN (US); Zach Brown, Kalamazoo, MI (US); Dayne Killingsworth, South Bend, IN (US)

(73) Assignee: SPX Corporation, Charlotte, NC (US)

( * ) Notice: Subject to any disclaimer, the term of this patent is extended or adjusted under 35 U.S.C. 154(b) by 166 days.

(21) Appl. No.: 10/426,799

(22) Filed: May 1, 2003

(65) Prior Publication Data

US 2004/0216857 A1 Nov. 4, 2004

(51) Int. Cl.[7] ..... B22D 17/10
(52) U.S. Cl. ..... 164/113; 164/900; 164/312
(58) Field of Search ..... 164/113, 900, 164/312

(56) References Cited

U.S. PATENT DOCUMENTS 4,865,808 A * 9/1989 Ichikawa et al. ..... 428/548
4,917,359 A * 4/1990 Ichikawa et al. ..... 266/208
5,009,844 A * 4/1991 Laxmanan ..... 148/95
5,571,346 A * 11/1996 Bergsma ..... 148/550
5,758,707 A * 6/1998 Jung et al. ..... 164/4.1
5,787,959 A * 8/1998 Laxmanan et al. ..... 164/66.1
5,968,292 A * 10/1999 Bergsma ..... 148/437
6,427,754 B1 * 8/2002 Ozcan ..... 164/95

OTHER PUBLICATIONS

*"Solidification of Hypoeutectic Aluminum—Silicon Alloys"*; D.H. StJohn, et al.; Materials Forum (1999); pp. 137–152.

*"Introduction to Casting Technology"*; Training in Aluminum Application Technologies (TALAT) Lecture 3201; John Campbell and Richard A. Harding, IRC in Materials, The University of Birmingham (1994); pp. 1–29.

* cited by examiner

*Primary Examiner*—Kiley S. Stoner
*Assistant Examiner*—Len Tran
(74) *Attorney, Agent, or Firm*—Baker & Hostetler LLP

(57) ABSTRACT

A method for the refining of primary aluminum in hypoeutectic alloys by mixing at least two hypoeutectic alloys into a solid/semi-solid hypoeutectic slurry is described. The method provides control of the morphology, size, and distribution of primary Al in a hypoeutectic Al—Si casting by mixing a hypoeutectic Al—Si liquid with solid hypoeutectic Al—Si particles to impart desirable mechanical properties. The invention enables SSM molding of hypoeutiectic alloys without the need for secondary processing steps associated with other rheocasting processes.

16 Claims, 2 Drawing Sheets

FIG. 2 (All Images at 100 X)
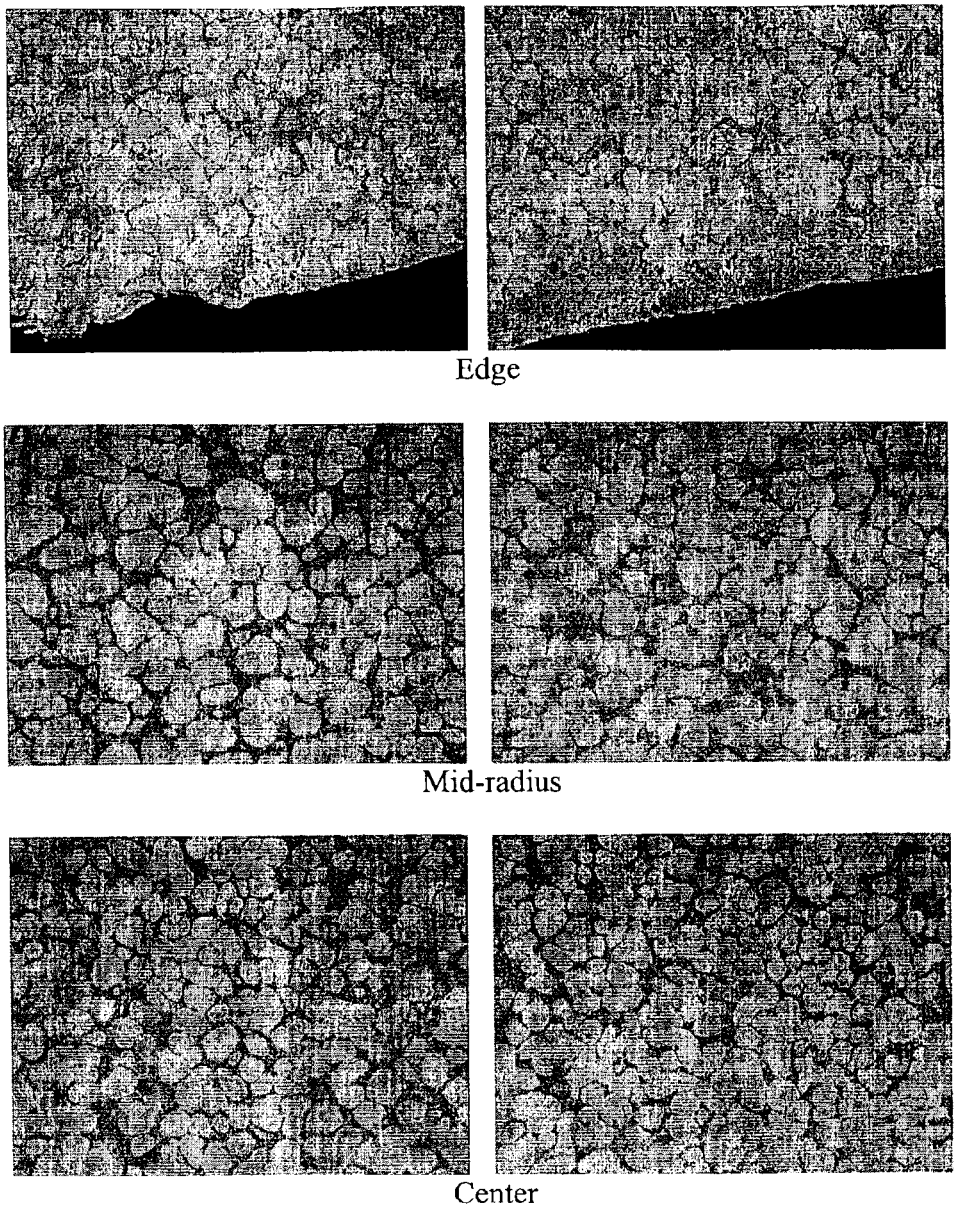

SEMI-SOLID METAL CASTING PROCESS OF HYPOEUTECTIC ALUMINUM ALLOYS

FIELD OF THE INVENTION

The present invention relates generally to a process of casting metal alloys. More particularly, the present invention relates to a method of semi-solid metal casting of aluminum-silicon alloys.

BACKGROUND OF THE INVENTION

Conventional casting methods such as die casting, gravity permanent mold casting, and squeeze casting have long been used for Aluminum-Silicon (Al—Si) alloys. However, where semi-solid metal (SSM) casting of Al—Si alloy materials has been involved, the conventional methods have not been employed successfully to date. Rheocasting and thixocasting are casting methods that were developed in an attempt to convert conventional casting means to SSM casting. However, these SSM methods require additional retrofitting to conventional casting machinery and challenges remain the ability to manipulate the microstructures of primary Al and/or Si in the cast part for improving cast performance.

Accordingly, it is desirable to provide a method of casting SSM Al—Si alloys utilizing both conventional and rheocasting means that can impart desirable mechanical properties. In particular, there is a need for a process to control the nucleation of primary Al particles in hypoeutectic Al—Si alloys to limit the formation of large primary Al particles. Further still, it is desirable to provide a method of producing products with Al—Si alloy castings by conventional or rheocasting techniques wherein the temperature of the semi-solid slurry can be controlled.

SUMMARY OF THE INVENTION

The foregoing needs are met, to an extent, by the present invention, wherein according to one embodiment, an SSM casting process is provided that generates products with Al—Si alloy castings by conventional or rheocasting techniques wherein the temperature and the final morphology of the primary Al of the product can be controlled.

In accordance with one embodiment of the present invention an SSM casting process is provided comprising heating a first Al—Si hypoeutectic alloy to a first temperature, combining the heated alloy with a second Al—Si hypoeutectic alloy having a second temperature to form a semi-solid metal, cooling the combined first and second Al—Si hypoeutectic alloys for a determined length of time, and then casting the semi-solid metal. The length of cooling time can be zero. The alloys may be of the same or different chemical composition. The alloys may also be heated to the same or different temperatures.

In accordance with another embodiment of the present invention an SSM casting process is provided wherein the temperature of a first Al—Si hypocutectic alloy is higher than the temperature of a second Al—Si hypoeutectic alloy such that there is a difference in temperature between the first and second Al—Si hypoeutectic alloys. The difference in temperature may be chosen to achieve a determined rate of cooling which may allow control of primary Al particle size in the final cast product. In some embodiments, hypoeutectic Al—Si cast products may have Al particles with an average diameter ranging from about 40 microns to about 60 microns. The difference in temperature may also be chosen to achieve a faster rate of cooling of the hotter alloy as compared to heating the hotter Al—Si hypoeutectic alloy and allowing the hotter alloy to cool independently at room temperature.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 2 shows the representative microstructure from different locations within a castings produced by the process of FIG. 1.

DETAILED DESCRIPTION OF PREFERRED EMBODIMENTS OF THE INVENTION

Figure 1:
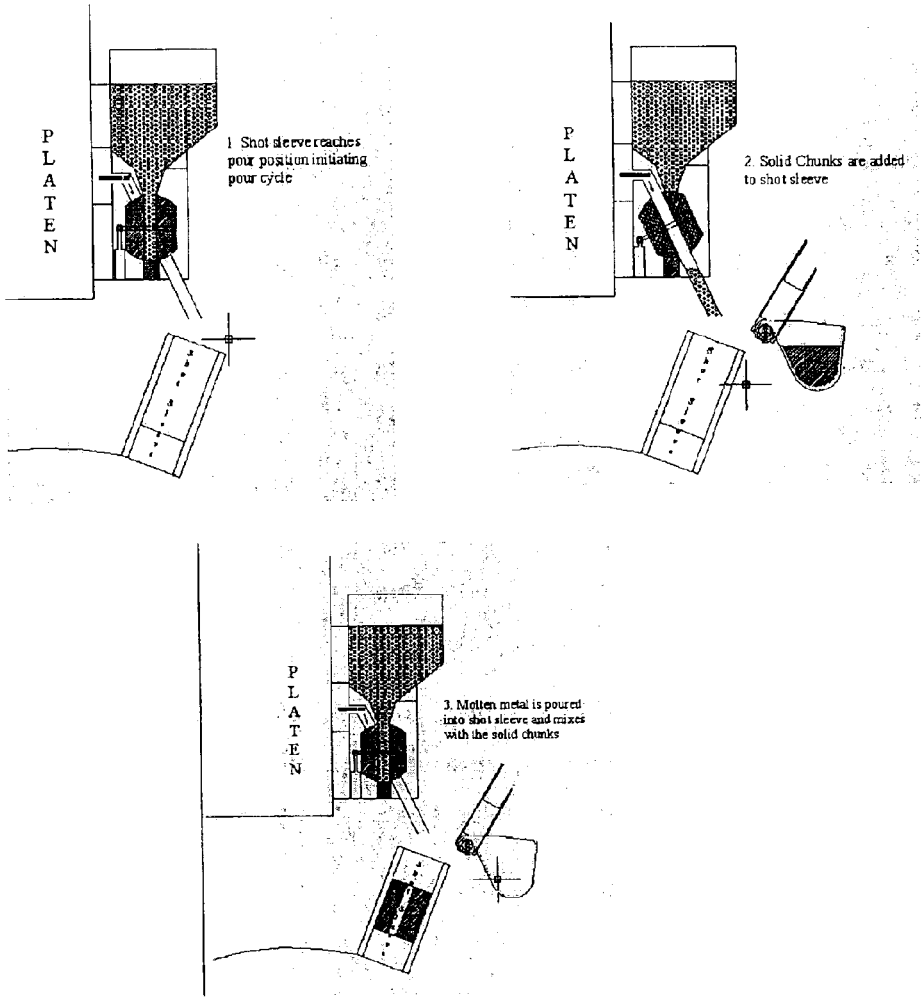
FIG. 1 is a graphic representation of one embodiment of how the inventive process can be performed.

The present invention provides a method for controlling the composition, temperature and microstructure of Al—Si alloys prior to SSM casting in an attempt to control the mechanical properties of the final cast product. Generally, this is accomplished by mixing at least two hypoeutectic Al—Si alloys. By definition, aluminum alloys with up to but less than about 11.7 weight percent Si are defined "hypoeutectic", whereas those with greater than about 11.7 weight percent Si are defined "hypereutectic". In all instances, the term "about" has been incorporated in this disclosure to account for the inherent inaccuracies associated with chemical weights and measurements known and present in the art.

The metallic composition of alloys used in current methods for SSM casting is limited to the availability and composition of the starting materials. In contrast, according to the present invention, a broad range of metallic compositions are achievable from the same starting materials because the combination of hypoeutectic alloys into a singular hypoeutectic alloy allows for the manipulation of the final concentration of Si in the Al—Si alloy by controlling the composition and mass of the starting materials or semi-solid slurries.

Mixed hypoeutectic alloy compositions can be formed by combining two or more aluminum alloys comprising up to but less than about 11.7 percent Si in aluminum. In one embodiment, two Al—Si alloys are combined to form a mixed hypoeutiectic alloy. It will be noted that one of the starting materials need not be an Al—Si alloy, but alternatively, purely Aluminum. In yet other embodiments, combinations of two or more hypoeutectic alloys with the same Al—Si chemistry (i.e., same weight percent Si) are disclosed herein. One example of a hypoeutectic alloy with about 7% Si is developed by Elkem (under the trademark of SIBLOY®).

In addition to imparting unique physical properties to the end product, the concentration of Si in aluminum has consequences in the phase profile of any given alloy at any given temperature. For example, hypoeutectic Al—Si alloys begin to develop large Al particles as they begin to cool below the liquidus and into the SSM range. In a preferred embodiment, the instant invention teaches a method of mixing two Al—Si alloys at different temperatures together so that the amount of time the mixture spends in the transitional semi-solid phase is minimized.

Temperature control of the alloys can be achieved by mixing two or more hypoeutectic alloys as in the present invention. Generally, one alloy is heated to a liquid state and then mixed with an alloy of cooler temperature to bring the combined melt within the SSM range. The cooler alloy may serve as a heat sink when the hotter alloy is combined therewith, thus bringing the combined alloy mixture into the semi-solid regime more rapidly than using conventional coolers or air cooling. In some embodiments, one or more of the hypoeutectic alloys is maintained in a solid state. Preferably, the hotter or liquid alloy is generally poured into the cooler or solid hypoeutectic alloy; however, it is also possible to add the cooler alloy to the hotter alloy. Solid phase alloys may be presented in any form known in the art, which include, but are not limited to, grains, chips, and/or pellets.

In one embodiment, when squeeze casting is involved, the alloys may be heated to a range of from about 690° C. to about 715° C. In another embodiment, when the SSM is refined (e.g., grain refined or electromagnetically-stirred), the alloys may be heated typically to a range of from about 577° C. to about 580° C. In yet other embodiments, one of the alloys to be combined may not be heated at all, i.e., it may be used at ambient room temperature.

In a preferred embodiment of the invention, a hotter alloy is combined with a cooler alloy, and preferably, the hotter alloy is raised to about 640° C. and the cooler alloy is left at ambient or room temperature. This large temperature gradient allows for a quicker extraction of heat from the hotter parent alloy than with conventional coolers and decreases the time necessary for the liquid alloy to drop in temperature to a semi-solid/slurry processing temperature. Such rapid nucleation of the primary Al phase is thought to result in a more homogeneous microstructure throughout the material.

In this manner, the current invention can enable SSM casting of hypoeutectic alloys via the rheocast method without secondary processing equipment such as external cooling mechanisms, or induction heating apparatuses. For example, in one embodiment, current squeeze casting processes can now be converted to an SSM casting process at significantly reduced retrofitting costs by using the teachings described herein to cool hypocutectic Al—Si alloys to the SSM range rather than with additional abovementioned apparatuses.

FIG. 1 is a graphic representation of a squeeze casting process in accordance with one embodiment of the invention used for squeeze casting. Persons of ordinary skill will recognize that alternate embodiments are also possible within the scope and spirit of the present invention, and that therefore, the invention should not limited to the details of the construction or the arrangement of the components described herein. According to the embodiment in FIG. 1, a shot sleeve on a casting device first reaches a pour position thereupon initiating a pour cycle. The shot sleeve is a receptacle to contain measured amounts of liquid/slurry material to be later transferred into a die cavity. Solid chunks of the cooler hypoeutectic alloy are added to the shot sleeve. Thereafter, molten metal of the hotter hypoeutectic alloy is poured into the shot sleeve and mixed with the solid chunks. The combination in this embodiment leads to rapid dissolution of the solid material into the molten metal and in so doing, drops the initial temperature of the molten metal. Once in the SSM range, the slurry is then injected, by any one of a variety of methods known in the art, into the die cavity and proceeds to be cast.

As mentioned above, the growth of Al particles in the semi-solid phase is directly correlated to the initial temperature and the time of cooling of the alloy before casting. The longer an alloy remains in the semi-solid phase, the likelihood for undesirable growth of large Al particles is increased. Alternatively, shortening the time an alloy spends in the SSM phase before casting minimizes the growth of large Al particles by maximizing the number of nucleating events, producing more Al particles of smaller size. FIG. 2 is representative of the microstructure of products cast by the inventive steps described.

FIG. 2 shows the microstructure of cast alloys after they have been quenched. In the particular embodiment presented, a 357 alloy (commercially available alloy of approximately 7% Si) was heated to 640° C. and then combined with 357 alloy chips at room temperature. The 357 alloy chips were about 0.25 $in^3$ in average size. The combined liquid mixture cooled to 587° C. by virtue of mixing of the two alloys of different temperature, before it was finally quenched. Three separate cross sections of the cast product were taken: the edge, mid-radius, and center. Microanalysis of the various sections of the casting demonstrates that the primary Al particles are relatively evenly distributed with minimal aggregate formation. The Al particles are seen as the light colored particles in the microstructure, and the background is the eutectic (i.e., a mixture of Al—Si). The Al particles shown range in size from about 40 microns to about 60 microns in diameter from the center of the cast though to the edge of the cast. The compactness of the Al particles can be assessed relative to a perfectly spherical particle and expressed as a ratio of $(2\pi r)^2/4\pi r^2$. Accordingly, a perfectly spherical Al particle would have a ratio of 1 and would appear as a circle on a micrograph, and larger ratios would indicate deviations therefrom. The compactness ratio of the center of the cast ranged from about 1.6 to 1.8 while the edge of the casting ranged from about 2.2 to about 3.0.

Analysis of the edge cross sections of FIG. 2 shows the morphology of primary Al to be less uniform and slightly radiating from a given point (star-shaped). This is generally observed at the outer edges of a casting where the molten liquid or slurry comes in direct contact with the cold surface of the die cast.

A more rapid drop in temperature results in greater nucleating events than if the temperature is dropped gradually. This has the desirable effect of generating multiple Al particles that are smaller in size (width and length), but also generally uniformly distributed through out the alloy. The even distribution of the Al particles, as seen in FIG. 2, allows for better prediction of mechanical properties with less likelihood of mechanical failure which in effect limit the average growth of the Al particles and diminished the likelihood of globular aggregates.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents maybe resorted to, falling within the scope of the invention.

What is claimed is:

1. A method for semi-solid metal casting, comprising:

providing a first aluminum-silicon hypoeutectic alloy;

providing a second aluminum-silicon hypoeutectic alloy;

heating the first alloy to a liquid state;

combining the first alloy and the at different temperatures to form a semi-solid metal;

cooling the semi-solid metal for a length of time effective to increase nucleation of primary aluminum particles in the combination; and casting the semi-solid metal to form a cast product.

2. The method of claim 1, wherein the length of time is also effective to restrict growth of a primary aluminum phase in the semi-solid metal.

3. The method of claim 1, further comprising:

providing a third aluminum-silicon hypoeutectic alloy with the first and second alloys; and combining the third alloy with the first and second alloys.

4. The method of claim 1, wherein at least one of the first and second alloys comprises from about 6 to about 8 percent silicon.

5. The method of claim 4, wherein at least one of the first and second alloys comprises about 7 percent silicon.

6. The method of claim 1, further comprising heating the second alloy before combining it with the first alloy.

7. The method of claim 6, wherein the heated first alloy is at a higher temperature than the heated second alloy.

8. The method of claim 6, wherein the second alloy is heated to a temperature from about 22° C. to about 660° C.

9. The method of claim 1, wherein the cast product comprises aluminum particles having an average diameter from about 40 microns to about 60 microns.

10. The method of claim 1, wherein the first alloy is heated to a temperature from about 577° C. to about 715° C.

11. The method of claim 10, wherein the first alloy is heated to a temperature from about 577° C. to about 580° C.

12. The method of claim 10, wherein the first alloy is heated to a temperature from about 690° C. to about 715° C.

13. The method of claim 10, wherein the first alloy is heated to a temperature of about 640° C. and wherein the casting step comprises squeeze casting.

14. The method of claim 1, wherein the cast product comprises aluminum particles having a compaction ratio from about 1.6 to about 3.0.

15. The method of claim 14, wherein the cast product comprises aluminum particles having a compaction ratio from about 1.6 to about 1.8.

16. The method of claim 1, wherein the difference in temperature between the first alloy and the second alloy is effective to produce the cast product comprising more homogeneous distribution of aluminum particles as compared to aluminum particles in a cast product made by traditional casting methods.

* * * * *

UNITED STATES PATENT AND TRADEMARK OFFICE

CERTIFICATE OF CORRECTION

PATENT NO. : 6,880,613 B2
DATED : April 19, 2005
INVENTOR(S) : Deepak Saha et al.

It is certified that error appears in the above-identified patent and that said Letters Patent is hereby corrected as shown below:

Title page,
Item [57], ABSTRACT,
Line 8, please replace “hypoeutiectic” with -- hypoeutectic --.

Column 5,
Line 21, please insert -- second alloy -- after “and the”;

Column 6,
Line 11, please replace “22°C.” with -- 22°C --;
Lines 16 and 18, please replace “577°C.” with -- 577°C --;
Line 20, please replace “690°C.” with -- 690°C --;
Line 22, please replace “640°C.” with -- 640°C --.

Signed and Sealed this

Fifth Day of July, 2005

JON W. DUDAS
*Director of the United States Patent and Trademark Office*